United States Patent [19]

Fletcher

[11] 3,981,680

[45] Sept. 21, 1976

[54] PROCESS FOR CONTINUOUSLY FIXING VAT DYES ON A TEXTILE WEB

[76] Inventor: John Milford Fletcher, R.F.D. No. 3, Box 376, Opelika, Ala. 36801

[22] Filed: Jan. 17, 1975

[21] Appl. No.: 541,737

[52] U.S. Cl. ..... 8/34; 8/149.1; 8/149.3

[51] Int. Cl.[2] ..... D06P 1/22

[58] Field of Search ..... 8/34, 149.1, 149.3

[56] References Cited

UNITED STATES PATENTS

| | | | |
|---|---|---|---|
| 2,487,197 | 11/1949 | Stott et al. | 8/34 |
| 3,000,688 | 9/1961 | Schubert et al. | 8/34 |
| 3,051,541 | 8/1962 | Clapp | 8/34 |

*Primary Examiner*—M. J. Welsh

[57] ABSTRACT

Savings in reductant are realized and effluent is reduced in the continuous process of steam fixing of vat dyes on textile web by expressing reductant-comprising liquor containing excess reductant from the web following the steam fixing step and applying expressed liquor, together with fresh reductant liquor, to web entering the fixing step.

3 Claims, 2 Drawing Figures

PROCESS FOR CONTINUOUSLY FIXING VAT DYES ON A TEXTILE WEB

BACKGROUND OF THE INVENTION

1. Field of the Invention

The invention is in the field of continuous dyeing of textile webs comprising cellulosic fibers with vat dyes.

2. Description of the Prior Art

The continuous vat dyeing of cellulosic fibers such as cotton and rayon alone or in combination with other fibers is an important industrial process.

Representative of trade processes for the continuous vat dyeing of textile webs is the process of Stott et al as described in U.S. Pat. No. 2,487,197. The process of Stott et al, in brief, comprises first the step of padding a clean textile web with an aqueous dispersion comprising a vat dye in the oxidized form, a process called pigment padding in the trade. Thereafter, usually following drying, the web is padded with a pad liquor comprising a reductant. The most commonly used reductant is sodium hydrosulfite combined with an approximately equal amount of sodium hydroxide. Following this process step, called chemical padding in the trade, the web is passed through an essentially anaerobic steamer where the dye is reduced to the sodium hydroxide-soluble leuco form which becomes fixed on the web. After leaving the steamer the dye is reoxidized to the insoluble form, normally by contacting the web with an aqueous oxidizing agent such as chromic acid-acetic acid or sodium perborate. Soaping, rinsing and drying of the web completes the process.

Although it is not the usual practice, it is also possible, in a similar process, to pad vat dyes onto the web in the leuco form. In this process one employs an aqueous pad liquor comprising the vat dye in mixture with a reductant.

In dyeing webs comprising blends of cellulosic fibers with other fibers, it is usual to add other dyes suitable for the noncellulosic fiber. For example, a disperse dye may be added to dye polyester fibers in cotton-polyester blend. Between the steps of pigment padding and chemical padding the disperse dyes are normally fixed by heating.

The above described dyeing processes produce substantial amounts of waste water effluent. The dyeing and finishing segment of the textile industry, in which the instant invention would be employed, is under increasing pressure to reduce its effluent to the environment.

SUMMARY OF THE INVENTION

In the process of continuous vat dyeing of a textile web comprising passing said web through a steamer having a web entrance and a web exit, and applying reductant-comprising liquor to said web by means situate at or near said web entrance, the improvement, characterized by savings of reductant and reduced effluent, consisting in:

A. applying reductant-comprising liquor to said web by means situate at or near said web entrance in excess of that expressable by squeeze rolls;

B. expressing liquor from said web by means of squeeze rolls at or near said web exit; and C. collecting and applying expressed liquor to said web together with reductant-comprising liquor by said means situate at or near said web entrance.

DETAILED DESCRIPTION OF THE INVENTION

Figure 1:
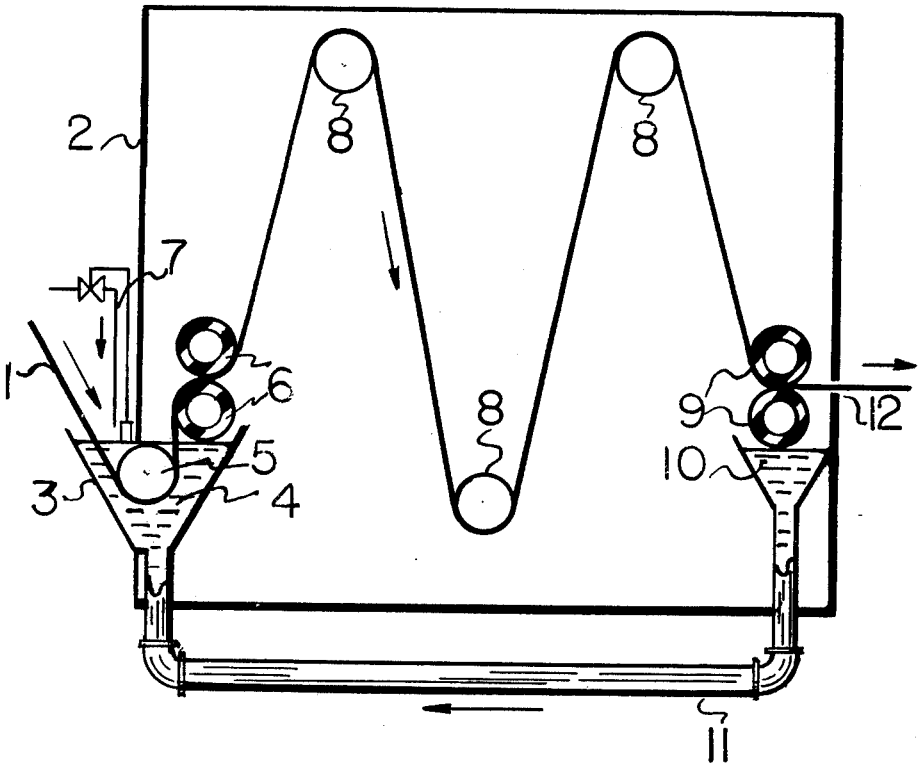
FIG. 1 shows an embodiment of the invention wherein a padder functions to apply liquor to the web.

I prefer to carry out the invention process in a device essentially as shown in FIG. 1. FIG. 1 is a longitudinal section through a steamer wherein in this embodiment dry, pigment padded textile web 1 enters steam filled enclosure 2 after passage through a chemical padder serving also as a seal and comprising padder pan 3 containing reductant-comprising liquor 4, guide roll 5 and rubber covered squeeze rolls 6. Feed assembly 7, responsive to the liquid level of chemical pad liquor 4 provides reductant-comprising liquor from a source not shown to padder pan 3 to the extent that the level is not maintained by expressed liquor as hereinafter described.

Textile web 1 passes over guide rolls 8 for a time sufficient for the vat dye to be reduced to the soluble leuco form and in this form to have become fixed on textile web 1. Thereafter textile web 1 passes between rubber coated squeeze rolls 9 whereby to express liquor 10, which returns to padder pan 3 via conduit 11. Textile web 1 thereafter passes out of enclosure 2 through exit 12. Outside enclosure 2, web 1 is normally oxidized, soaped, rinsed and dried according to art processes not shown.

The process has been described in terms of chemical padding of a pigment padded web. The invention process is operable with all such processes wherein a reductant-comprising pad liquor is employed as, for example, in the padding of a leuco vat dye liquor comprising a reductant. The process is operable with all manner of padable textiles comprising materials collectively called herein a textile web. The device of this invention can also advantageously be used with other dye types as hereinafter described.

The art worker employing the chemical pad process of Stott et al and wishing to conserve reductant and reduce effluent, would set the chemical padder squeeze rolls so as to reduce the reductant-comprising liquor content of the web to the minimum, normally about 75% of the weight of the web more or less. The worker would have adjusted the concentration of reductant in the liquor so as to provide to the web an adequate amount of reductant usually about 1% of the weight of the web, of sodium hydrosulfite and an equal weight of sodium hydroxide. Of this amount about 75% will be consumed to reduce the vat dye to the leuco form and through losses, and the rest, which the experience of the trade has shown to be necessary, will remain on the web and will be discharged as effluent during the oxidation, soaping and rinsing steps which follow.

The prudent art worker would not risk spoiling the dyeing by employing less than about 25% excess reductant. He is aware that he does not normally know precisely the stoiciometric amount needed to reduce a particular dye in a particular depth of shade. He also knows that the forward reaction rate is favored by excess reductant and that he cannot accurately compensate for oxidation losses during storage and other losses due for example to small amounts of oxygen in the steam. Considerations such as these have led to the essentially universal practice of employing at least about 25% excess reductant.

According to my invention a substantial proportion of the excess now lost as effluent is saved. In the practice of my invention one applies to the web more or less the art amounts of reductant, for example about 1% sodium hydrosulfite and an equal amount of sodium hydroxide on the weight of the web. However, the reductant-comprising liquor is diluted so that one can apply a volume thereof to the web which is greater than can be expressed by squeeze rollers. After steaming the web, liquor is expressed so as to reduce the proportion of liquor on the web to a minimum. The degree to which savings can be realized on reusing the expressed liquor depends on the amount of reductant liquor the web can retain during its passage through the steamer and the degree to which liquor can be expressed at or near the web exit. In order to apply large volumetric proportions of reductant-comprising liquor to the web squeeze rolls 6 will be set relatively loosely. In some cases it will be preferred to pass the web over one or more bars instead of using squeeze rolls at all, and in other cases neither rolls nor bars will be employed. Normally squeeze rolls 9 will be set to express the maximum practical amount of liquor.

Other equipment arrangements are of course operable. For example, although not preferred, the padder assembly at the web entrance may be placed outside enclosure 2. Also, if desired the padder assembly may be placed entirely within enclosure 2, web 1 entering enclosure 2 through a slot. Also squeeze rolls 9 may be set outside enclosure 2 and expressed liquor 10 in combination with a guide roll can serve as a liquid seal in a manner analogous to the drawing arrangement of the padder assembly at the entrance of the steamer.

Figure 2:
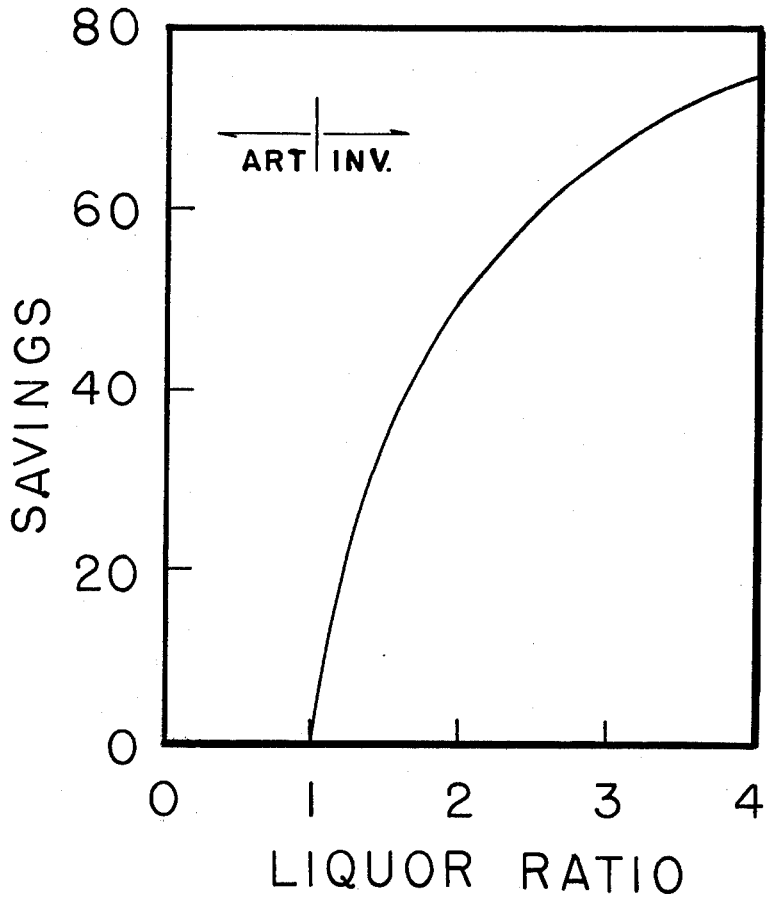
FIG. 2 is a graph relating savings of reductant expressed as percent of the excess applied to the web versus the weight ratio of liquor applied to the web at or near the web entrance to the liquor remaining on the web after passing between squeeze rolls at or near the web exit.

FIG. 2 shows graphically the relationship between "Liquor Ratio" and realizable savings in percent of the excess reductant employed. "Liquor Ratio" is the ratio of the weight of liquor on a unit length of web after application of liquor at or near the web entrance and the weight of liquor on the web after expression of liquor at or near the web exit. Savings are expressed as percent of the excess which is saved. As is seen, the higher the "Liquor Ratio" the greater the savings.

The practically realizable ratio will depend on the construction of the web. A value of about four is normally about the maximum realizable, for example with towelling.

Although my invention has been exemplified with sodium hydrosulfite reductant, it is clear that other reductants are operable such as those taught by Etters in U.S. Pat. No. 3,645,665.

Ancillary savings also result from the practice of my invention. For example, it follows that a decrease in the amount of reductant passed to the art oxidation step results in a lesser oxidizing agent requirement. Also in those cases wherein dye-fiber equilibrium is not reached during steaming in embodiments comprising either chemical padding, leuco dye padding or equivalent application to the web, savings in dye are realized by virtue of the effectively longer time of fiber-dye contact.

In those cases where equilibrium is not reached savings of other types of substantive dyes such as sulfur, direct and acid dyes can be achieved using the equipment of this invention. Normally condensation of steam on the web is not extensive. To the degree that it occurs, savings are increased over those herein above set out.

I claim:

1. In the process of continuous vat dyeing of a textile web comprising passing said web through an essentially anaerobic steamer having a web entrance and a web exit and at or near said entrance, applying to said web, by means situate at or near said entrance, a vat dye and reductant liquor obtained either by applying to the web a preformed aqueous liquor comprising a vat dye and a reductant or by applying a reductant liquor to a web carrying vat dye in the oxidized form, and vat dye being reduced by said reductant liquor and fixed to the web during passage through the steamer, the improvement consisting in:

A. applying, by means situate at or near said web entrance a vat dye and reductant liquor or a reductant liquor in excess of that expressable by squeeze rolls;

B. expressing liquor from said web by means of squeeze rolls situate at or near said web exit;

C. collecting and applying expressed liquor to said web together with vat dye and reductant liquor or reductant liquor by said means situate at or near said web entrance.

2. The process of claim 1 wherein means for applying expressed liquor together with vat dye and reductant liquor or reductant liquor, situate at or near the web entrance, is a padder.

3. The process of claim 1 wherein the weight ratio of total liquor applied to the web at or near the web entrance to the liquor remaining on the web after expression at or near the web exit is greater than one and less than about four.

* * * * *